US010125560B2

(12) United States Patent
Kasperski et al.

(10) Patent No.: US 10,125,560 B2
(45) Date of Patent: Nov. 13, 2018

(54) WELLBORE BAILER

(71) Applicant: Halliburton Energy Services, Inc., Houston, TX (US)

(72) Inventors: Bryan William Kasperski, Carrollton, TX (US); Jack Gammill Clemens, Fairview, TX (US); George Nathan Aldredge, Carrollton, TX (US); Matthew Craig Mlcak, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 523 days.

(21) Appl. No.: 14/439,756

(22) PCT Filed: Nov. 27, 2012

(86) PCT No.: PCT/US2012/066591
§ 371 (c)(1),
(2) Date: Apr. 30, 2015

(87) PCT Pub. No.: WO2014/084807
PCT Pub. Date: Jun. 5, 2014

(65) Prior Publication Data

US 2015/0292288 A1 Oct. 15, 2015

(51) Int. Cl.
*E21B 27/02* (2006.01)
*E21B 33/13* (2006.01)

(52) U.S. Cl.
CPC ..... *E21B 27/02* (2013.01); *E21B 33/13* (2013.01)

(58) Field of Classification Search
CPC ..... E21B 27/02; E21B 33/13
See application file for complete search history.

(56) References Cited

U.S. PATENT DOCUMENTS

| | | | |
|---|---|---|---|
| 4,696,343 | A | 9/1987 | Anderson et al. |
| 5,188,183 | A | 2/1993 | Hopmann et al. |
| 5,392,856 | A | 2/1995 | Broussard, Jr. et al. |
| 6,571,886 | B1 | 6/2003 | Sullivan et al. |
| 7,143,776 | B2 | 12/2006 | Sundholm |

(Continued)

OTHER PUBLICATIONS

PCT International Preliminary Report on Patentability, PCT/US2012/066591, dated Jun. 11, 2015, 13 pages.

(Continued)

*Primary Examiner* — Giovanna C. Wright
*Assistant Examiner* — Kristyn A Hall
(74) *Attorney, Agent, or Firm* — Scott Richardson; Parker Justiss, P.C.

(57) ABSTRACT

A wellbore bailer includes a bailer body that includes a top end, a tubular portion, and a nose, the tubular portion adapted to at least partially enclose a wellbore fluid and the nose including an outlet; a piston arranged in the tubular portion uphole of the wellbore fluid; a passage fluidly coupled to at least one of a pressure chamber or the fluid outlet, the pressure chamber arranged uphole of the piston and adapted to at least partially enclose a pressurized fluid; a pressure barrier arranged across the passage; and an actuator including a puncture member adapted to pierce the pressure barrier based on adjustment of the actuator from an unactuated position to an actuated position, the piston urged by the pressurized fluid to forcibly expel the wellbore fluid through the outlet based on piercing of the pressure barrier by the puncture member.

26 Claims, 5 Drawing Sheets

(56) References Cited

U.S. PATENT DOCUMENTS

| | | | |
|---|---|---|---|
| 7,597,150 | B2 | 10/2009 | Clem |
| 7,610,964 | B2 | 11/2009 | Cox |
| 8,136,584 | B2 | 3/2012 | Burnett et al. |
| 8,141,639 | B2 | 3/2012 | Gartz et al. |
| 2004/0144569 | A1 | 7/2004 | Pritchard et al. |
| 2010/0155054 | A1 | 6/2010 | Innes et al. |
| 2010/0307773 | A1 | 12/2010 | Tinnen et al. |
| 2010/0307774 | A1 | 12/2010 | Tinnen |
| 2011/0174068 | A1 | 7/2011 | Irani et al. |
| 2011/0259607 | A1 | 10/2011 | Carisella |
| 2012/0160483 | A1 | 6/2012 | Carisella |

OTHER PUBLICATIONS

Omega Completion Technology Ltd., "Cement Dump Bailer", copyright 2012, 2 pages.

PCT International Search Report and Written Opinion of the International Searching Authority, PCT/US2012/066591, dated Aug. 19, 2013, 17 pages.

WELLBORE BAILER

CROSS-REFERENCE TO RELATED APPLICATIONS

This Application is a 371 U.S. National Phase Application and claims the benefit of priority to International Application No. PCT/US2012/066591, filed in Nov. 27, 2012 and entitled "Wellbore Bailer", the contents of which are hereby incorporated by reference.

TECHNICAL BACKGROUND

This disclosure relates to a wellbore bailer for a downhole tool system.

BACKGROUND

A dump wellbore bailer tool operates to deposit material, typically cement, in a wellbore. For example, a dump wellbore bailer tool can be used to deposit cement onto a plug in the wellbore, to permanently place the plug. Some conventional wellbore bailer tools include a rupture disk that seals the material to be deposited inside a cylinder. A plunger is fixed at the bottom of the cylinder by shear pins. The wellbore bailer tool is carried into the well on a conveyance (e.g., coiled tubing, wireline, e-line, slickline, or otherwise), and jarred down onto the plug or other subsurface device on which the material is deposited. The jarring breaks the shear pins so that material to be deposited flows from the cylinder into the wellbore. Then, the wellbore bailer tool is retrieved to the surface on the conveyance.

DETAILED DESCRIPTION

Figure 1:
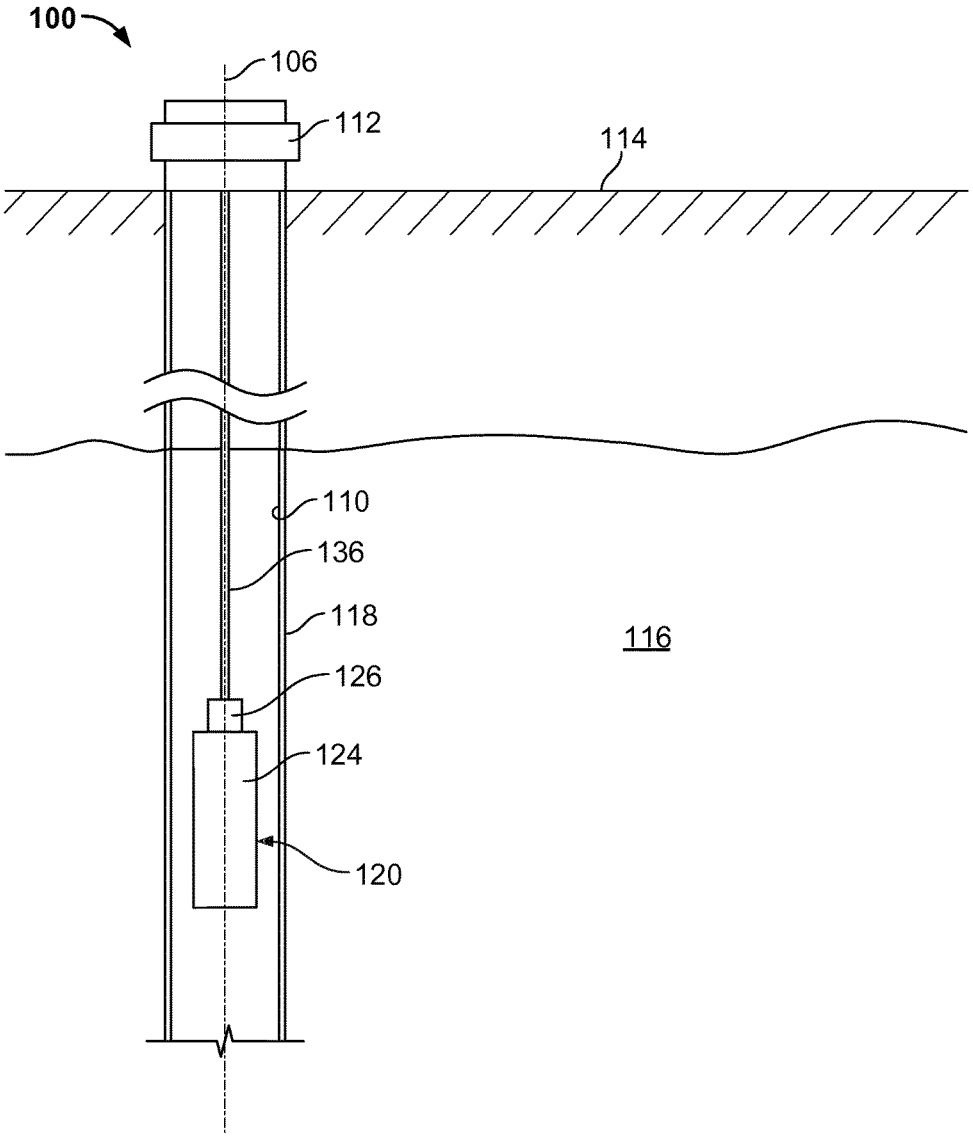
FIG. 1 illustrates a cross-sectional view of a well system that includes an example implementation of a wellbore bailer.

The present disclosure relates to a wellbore bailer. In one general implementation, a wellbore bailer includes a bailer body that includes a top end, a tubular portion, and a nose, the tubular portion adapted to at least partially enclose a wellbore fluid and the nose including an outlet; a piston arranged in the tubular portion uphole of the wellbore fluid; a passage fluidly coupled to at least one of a pressure chamber or the fluid outlet, the pressure chamber arranged uphole of the piston and adapted to at least partially enclose a pressurized fluid; a pressure barrier arranged across the passage; and an actuator including a puncture member adapted to pierce the pressure barrier based on adjustment of the actuator from an unactuated position to an actuated position, the piston urged by the pressurized fluid to forcibly expel the wellbore fluid through the outlet based on piercing of the pressure barrier by the puncture member.

In a first aspect combinable with the general implementation, the passage is fluidly coupled to the pressure chamber.

A second aspect combinable with any of the previous aspects further includes a port open to an exterior of the wellbore bailer and fluidly coupled to the pressure chamber through the passage.

In a third aspect combinable with any of the previous aspects, the passage is fluidly coupled to the pressure chamber, and the passage is fluidly coupled between an uphole surface of the floating piston and an exterior of the wellbore bailer after actuation of the actuator.

A fourth aspect combinable with any of the previous aspects further includes a flow restriction arranged across the fluid outlet, the flow restriction including a one-way check valve or a shear valve.

In a fifth aspect combinable with any of the previous aspects, the passage is fluidly coupled to the fluid outlet and the piston includes a first piston.

A sixth aspect combinable with any of the previous aspects further includes a second piston arranged uphole of the pressure chamber, the fluid enclosed between the second piston and the first piston.

In a seventh aspect combinable with any of the previous aspects, the passage is fluidly coupled between a downhole surface of the first piston and an exterior of the wellbore after actuation of the actuator.

An eighth aspect combinable with any of the previous aspects further includes an adjustable flow restriction arranged in a passageway of the second piston.

In a ninth aspect combinable with any of the previous aspects, the actuator includes a linear actuator configured to adjust from the unactuated position to the actuated position in response to a pyrotechnic event.

In a tenth aspect combinable with any of the previous aspects, the linear actuator further includes a portion of gas proppant ignitable by the pyrotechnic event to exert a force to move the puncture member to pierce the pressure barrier; and a linear actuator circuit that is coupled to a switch, the switch adjustable from an open position to a closed position to generate the pyrotechnic event.

In an eleventh aspect combinable with any of the previous aspects, the linear actuator circuit includes a capacitor coupled in series with one or more timers; a battery coupled across the capacitor; and a transistor through which an energy stored in the capacitor flows to ignite a pyrotechnic initiator to generate the pyrotechnic event.

In a twelfth aspect combinable with any of the previous aspects, the linear actuator circuit is adapted to couple to a wireline.

In a thirteenth aspect combinable with any of the previous aspects, the switch is adjustable from the open position to the closed position based on a powered signal received by the linear actuator circuit on the wireline.

In a fourteenth aspect combinable with any of the previous aspects, the fluid includes a cement slurry.

A fifteenth aspect combinable with any of the previous aspects further includes a fill port fluidly coupled to the tubular portion.

In another general implementation, a method includes receiving a powered signal at a wellbore bailer that includes a tubular adapted to at least partially enclose a wellbore fluid; actuating an actuator of the wellbore bailer with the powered signal; based on the actuation, urging a pin of the actuator to pierce a burst disk arranged in a passageway that is fluidly coupled to at least one of a pressure chamber of the wellbore bailer or a fluid outlet of the wellbore bailer; and based on piercing of the burst disk by the pin, urging a piston of the wellbore bailer that is arranged in the tubular uphole of the wellbore fluid to forcibly expel the wellbore fluid through the fluid outlet with a pressurized fluid at least partially enclosed within the pressure chamber.

In a first aspect combinable with the general implementation, the passageway is fluidly coupled to the pressure chamber.

A second aspect combinable with any of the previous aspects further includes, based on piercing of the burst disk by the pin, fluidly coupling the pressure chamber to the wellbore through the passageway such that a pressure of the fluid in the pressure chamber is at or about a hydrostatic pressure in the wellbore.

In a third aspect combinable with any of the previous aspects, the hydrostatic pressure of the wellbore is greater than a pressure of the wellbore fluid enclosed in the tubular.

In a fourth aspect combinable with any of the previous aspects, the passageway is fluidly coupled to the fluid outlet and the piston includes a first piston.

A fifth aspect combinable with any of the previous aspects further includes enclosing the fluid in the tubular between the first piston and a second piston that is arranged uphole of the pressure chamber.

A sixth aspect combinable with any of the previous aspects further includes receiving the wellbore fluid into the tubular through a fill port to urge the first piston from near a nose of the wellbore bailer coupled to the tubular toward the top of the wellbore bailer to pressurize the pressurized fluid at least partially enclosed within the pressure chamber.

A seventh aspect combinable with any of the previous aspects further includes further pressurizing the pressurized fluid in the pressure chamber as the wellbore bailer is moved through the wellbore from the terranean surface.

In an eighth aspect combinable with any of the previous aspects, the further pressurized fluid is at a pressure equal to or greater than a hydrostatic pressure of the wellbore prior to actuation of the actuator.

In a ninth aspect combinable with any of the previous aspects, actuating an actuator of the wellbore bailer with a powered signal includes initiating an explosive charge in response to the powered signal to actuate the actuator.

In a tenth aspect combinable with any of the previous aspects, initiating an explosive charge includes closing a switch in response to the powered signal; and igniting a portion of gas proppant by the explosive charge to exert a force to move the pin to pierce the burst disk.

An eleventh aspect combinable with any of the previous aspects further includes receiving, at the switch, the powered signal from one of a conveyance coupled to the wellbore bailer or a linear actuator circuit of the actuator.

In a twelfth aspect combinable with any of the previous aspects, the fluid includes a cement slurry.

In another general implementation, a positive displacement wellbore bailer includes a tubular adapted to enclose a portion of a material for a wellbore completion operation; a pressure chamber adapted to enclose a volume of fluid at a determined pressure; a floating piston arranged in the tubular between the material and the fluid; and a linear actuator arranged within a flow path that is fluidly coupled to one of the pressure chamber or the tubular, the linear actuator adapted to penetrate a burst disk arranged in the flow path upon actuation to release the volume of fluid to urge the floating piston to forcibly expel the material from an outlet of the wellbore bailer.

In a first aspect combinable with the general implementation, the flow path is fluidly coupled to the pressure chamber, and the flow path is fluidly coupled between an uphole surface of the floating piston and an exterior of the wellbore bailer after actuation of the linear actuator.

In a second aspect combinable with any of the previous aspects, the flow path is fluidly coupled to the tubular, and the flow path is fluidly coupled between a downhole surface of the floating piston and an exterior of the wellbore after actuation of the linear actuator.

Various implementations of a wellbore bailer according to the present disclosure may include one or more of the following features. For example, the wellbore bailer may require relatively low power to initiate the bailer so that, for example, a power source (e.g., battery or slickline) may only need to supply the low power. This may, for instance, provide for a more compact and robust wellbore bailer. The wellbore bailer may also be activated from a terranean surface as well as from a timer in the bailer, such as using a wireline (e.g., slickline) with minimal power requirements. The wellbore bailer may also more positively displace a fluid or slurry (e.g., cement) from the bailer upon actuation of the bailer as compared to conventional techniques.

Referring first to FIG. 1, an example well system 100 is shown prior to completion. The well system 100 includes a wellbore 118, which is substantially cylindrical that extends from a well head 112 at the surface 114 downward into the Earth into one or more subterranean zones 116 of interest that, in certain instances, include one or more hydrocarbon fluids (one shown). A portion of the wellbore 118 extending from the well head 112 to the subterranean zone 116 is shown lined with lengths of tubing, called casing 110, that is cemented into place. In other instances, the casing 110 can be omitted or the casing can extend to the termination of the wellbore 118. A portion of the wellbore 118 or the entire wellbore 118, extending from the well head 112 to the subterranean zone 116, can deviate from the vertical axis 106. The depicted well system 100 includes a deviated well, having a substantially inclined wellbore portion that extends from the surface 114 to the subterranean zone 116. The concepts herein, however, are applicable to many other different configurations of wells, including vertical wells, horizontal wells, slanted or otherwise deviated wells, and multilateral wells.

A wellbore bailer system 120 is shown as having been lowered from the surface 114 into the wellbore 118. The wellbore bailer system 120 is moved into the well on a conveyance 136, such as a slickline, wireline, e-line and/or other conveyance (e.g., coiled tubing or other tubular). The wellbore bailer system 120 includes a wellbore bailer tool 124 coupled to the conveyance 136 through a coupling 126. In some implementations, the wellbore bailer tool 124 may deposit a fluid or slurry (e.g., cement or other material) in the wellbore 118 upon actuation of the tool 124 (e.g., via a powered signal from the surface 114, via an internal signal, or otherwise). Upon actuation, a portion of the tool 124, such as a piston/cylinder assembly that includes a sharpened end on the piston, may burst a pressure barrier so that a pressurized fluid is released to urge a moveable surface to expel the material from the tool 124. The wellbore bailer tool 124 can be powered from the conveyance 136 (e.g., wireline) and/or from an internal control circuit that includes, for instance, a battery or other power storage.

In some instances, the wellbore bailer tool 124 is a dump wellbore bailer tool that carries a fluid or slurry, such as cement and/or other material, into the wellbore in an interior of the tool. In certain instances, the fluid carried by the wellbore bailer tool 124 has a higher density than a fluid in the wellbore 118. The fluid is retained in the wellbore bailer tool 124 with a valve closure (as described in detail with reference to FIGS. 2-4). The wellbore bailer tool 124 is then actuatable to deposit, by using positive displacement, the fluid in the wellbore. After the fluid flows from the interior of the wellbore bailer tool 124 into the wellbore 118, the wellbore bailer tool 124 is retrieved to the surface on the conveyance 136.

Figure 2:
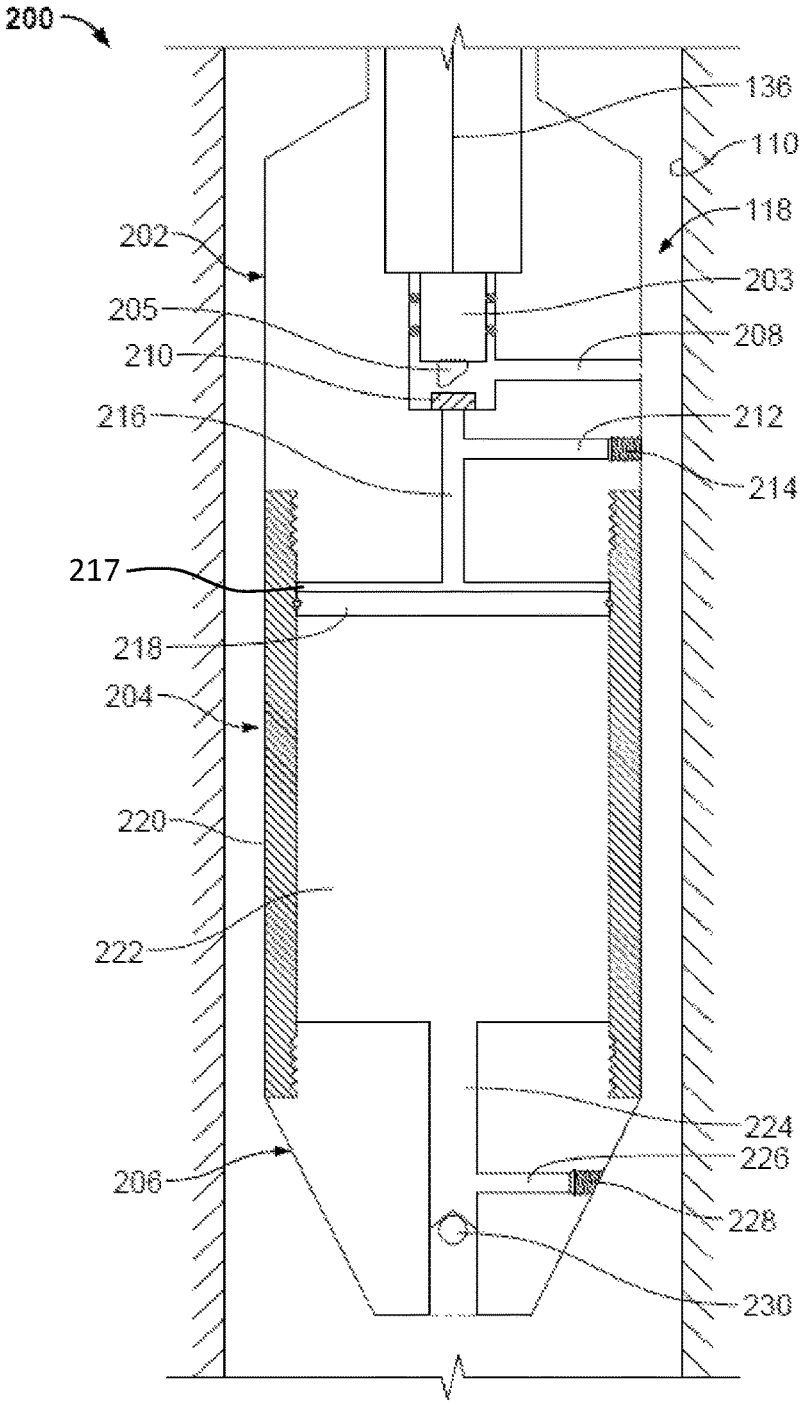
FIG. 2 illustrates a cross-sectional view of an example implementation of a wellbore bailer tool.

Turning now to FIG. 2 an example wellbore bailer tool 200, is depicted in cross-section. The wellbore bailer tool 200 can be used as wellbore bailer tool 124. The wellbore bailer tool 200 includes a bailer top end 202, a tubular 204, and a bailer nose 206. The bailer top end 202 is connected to the conveyance 136 to enable movement of the wellbore bailer tool 200 within wellbore 118. The components of the bailer top end 202 define an actuator 203, a pin 205, an open port 208, a burst disk 210, a fill port 212, a plug 214 and a conduit 216, and a pressure chamber 217. In this view, the open port 208 and conduit 216 form an ambient pressure passage configured to couple the wellbore 118 and the pressure chamber 217.

The components of the tubular 204 define a housing 220, a piston 218 and a fluid chamber 222. Although illustrated as a single housing 220, multiple housings 220 may be connected (e.g., threadingly) so that a greater volume of material may be stored in the fluid chamber 222. The components of the bailer nose 206 define an outlet 224, a fill port 226, a plug 228 and a valve 230. Valve 230 can be a check valve, a one-way valve, a shear valve or any other type of valve configuration compatible with the embodiments of the wellbore bailer tool 200.

In operation, the wellbore bailer tool 200, in an initial state, includes the piston 218 positioned at a lower end (e.g., downhole end) of the tubular 204 adjacent the outlet 224. The wellbore bailer tool 200 is connected to a fluid supply at the fill port 226. The fluid is circulated into the fluid chamber 222 through the fill port 226 by passing through the passageway 223. While the fluid is pumped into the fluid chamber 222, the fill port 212 is open and the pressure inside the fluid chamber 222 increases and pushes the piston 218 up, towards the upper end of the tubular 204. During the initial state of the wellbore bailer tool 200, a pressure lock keeps the valve 230 closed. When the piston 218 reaches a particular level (e.g., corresponding to a particular volume or to the top end of the tubular 204) the fill port 226 is closed by the plug 228 sealing the fluid in the fluid chamber 222 and the fill port 212 is closed by the plug 214.

In a filled state, the wellbore bailer tool 200 is transported to a particular location in the wellbore 118. The wellbore bailer tool 200 is then actuated by the actuator 203 to deposit the fluid in the wellbore. In some implementations, the actuator 203 can include a timer that initiates an activation circuit to actuate the actuator 203 (e.g., urge the pin 205 to break the burst disk 210). Several types of actuators 203 can be used. In some implementations, the actuator 203 may include several timers (e.g., one timer for 6 hours, one for 24 hours and one timer for 48 hours). For example, each timer can correspond to a preset time duration, allowing adequate operational time for the selected operation of the wellbore bailer tool 200.

In some implementations, the actuator 203 can include a location detector (e.g., depth detector), capable to actuate the actuator 203 at a particular location. In some implementations, the wellbore bailer tool 200 includes an actuator 203 capable to receive and further emit the actuation signals generated outside the wellbore bailer tool 200 and transmitted to the wellbore bailer tool 200 over the conveyance 136. In some implementations, the wellbore bailer tool 200 can be designed to be "fail safe," such that if there is any failure in the system (e.g., battery, or any other part) the actuator 203 is not actuated.

Figure 5:
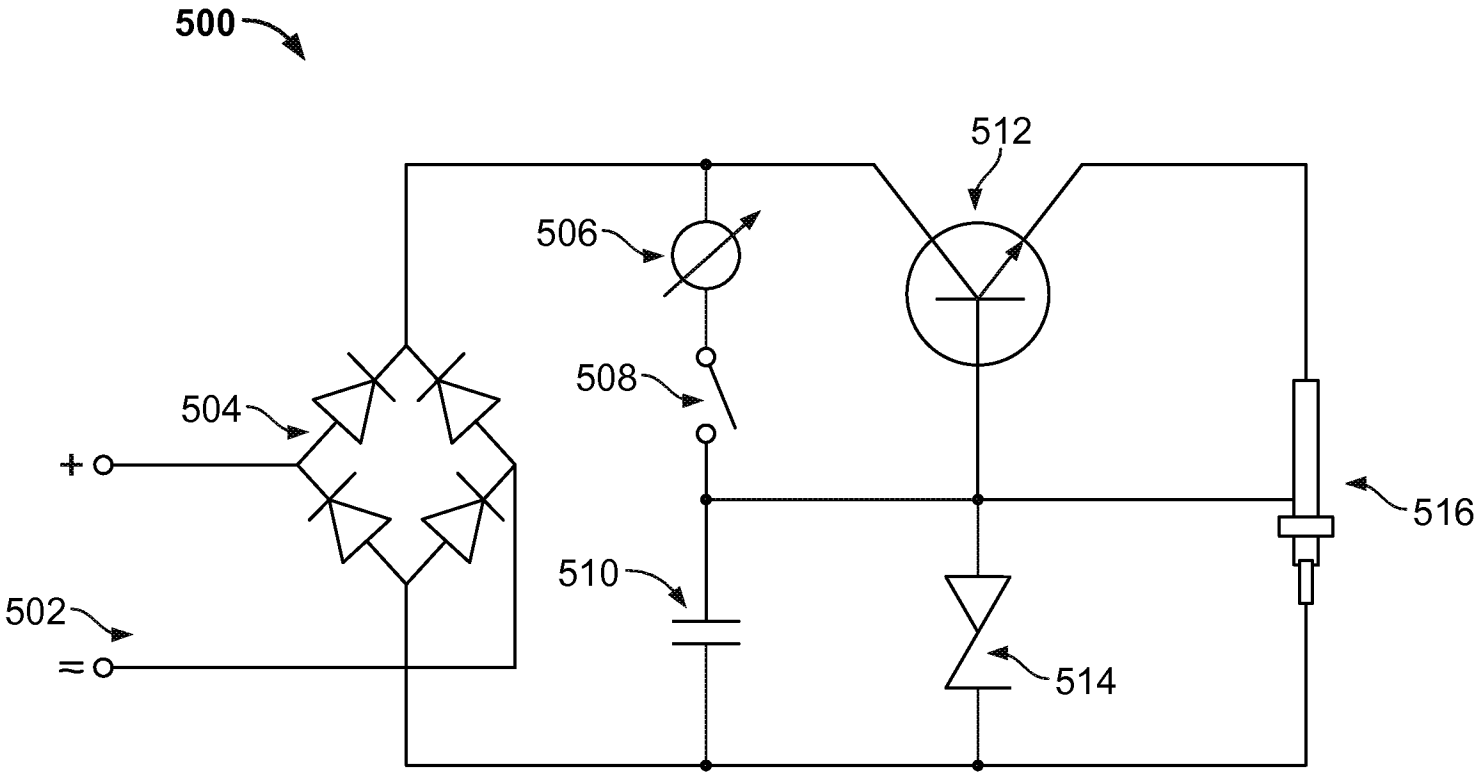
FIG. 5 illustrates an example timing circuit for a wellbore bailer.

The actuator 203 can be actuated by an explosive charge, a pyrotechnic actuator, or other device capable of generating sufficient mechanical energy to apply sufficient force to the pin 205 to break the burst disk 210. For example, turning to FIG. 5, an example activation circuit 500 for actuating the actuator 203 is shown. The example activation circuit 500 can be implemented, for example, as a timer in the actuator 203. As seen in FIG. 5, the circuit 500 is powered by a power source 502 and includes a semiconductor bridge 504, a timer 506, a switch 508, a capacitor 510, a transistor 512, a protection component 514, and a pyrotechnic initiator 516.

In some implementations, the semiconductor bridge 504 is used to rectify the input current received from a source 502 (e.g., a battery such as a 1.45 V zinc battery). In some implementations, the circuit 500 is open until an actuation signal is received. In some implementations, the actuation signal is generated by the timer 506. The timer 506 can produce an actuation signal to open or close the switch. In some implementations, at the closure of the switch 508 the energy stored in the capacitor 510 is discharged, generating a flow of current through the transistor 512. In some implementations, the circuit 500 includes a protection component 514 (e.g., a Zener diode or a resistor) that prevents any back electro-motive force (e.g., reverse voltage) from damaging the transistor.

In some implementations, the output signal generated by the transistor 512 activates the pyrotechnic initiator 516. The activation of the pyrotechnic initiator 516 initiates a rapid volumetric increase in a flammable gas (e.g., a proppant, propane, methane, butane, acetylene), stored in, for instance, a portion (e.g., cylinder) of the actuator 203, to urge the pin 205 out of the cylinder with a particular force. The magnitude of the force is sufficient to cause the pin 205 to break the burst disk 210. In some implementations, the magnitude of the force can be controlled through the volume and the concentration of the flammable gas.

In some implementations, the activation circuit 500 can be initiated, as described above, based on a timer or one of multiple timers. In another aspect, the activation circuit 500 may be initiated by a direct signal on a conveyance (e.g., wireline, or other conveyance), such as the conveyance 136. As another example, a sequence or pattern of tool motions of the tool 200, such as, for example, a sequence or pattern of jars or impacts, may initiate the activation circuit 500. In some aspects, a programmable device, such as an RFID tag that has been placed in the wellbore bailer 200 or other part of a tool string including the bailer 200, may initiate the actuation circuit 500.

Breaking the burst disk 210 may initiate an actuated state of the wellbore bailer tool 200. At the actuated state, the open port 208, which is open to the wellbore 118 and at or near a hydrostatic pressure of the wellbore 118, is fluidly coupled to the conduit 216. The pressure of the conduit 216, therefore, becomes at or near the hydrostatic pressure, and acts on the piston 218. The pressure in the fluid chamber 222 is above a particular threshold (e.g., 1 atm), while the hydrostatic pressure acting on an uphole surface of the piston 218 is much greater, resulting in positive displacement of the fluid from the fluid chamber 222 as the piston 218 is urged toward a downhole end of the chamber 222. The fluid is urged through the outlet 224 and the valve 230 into the wellbore 118.

Figure 3:
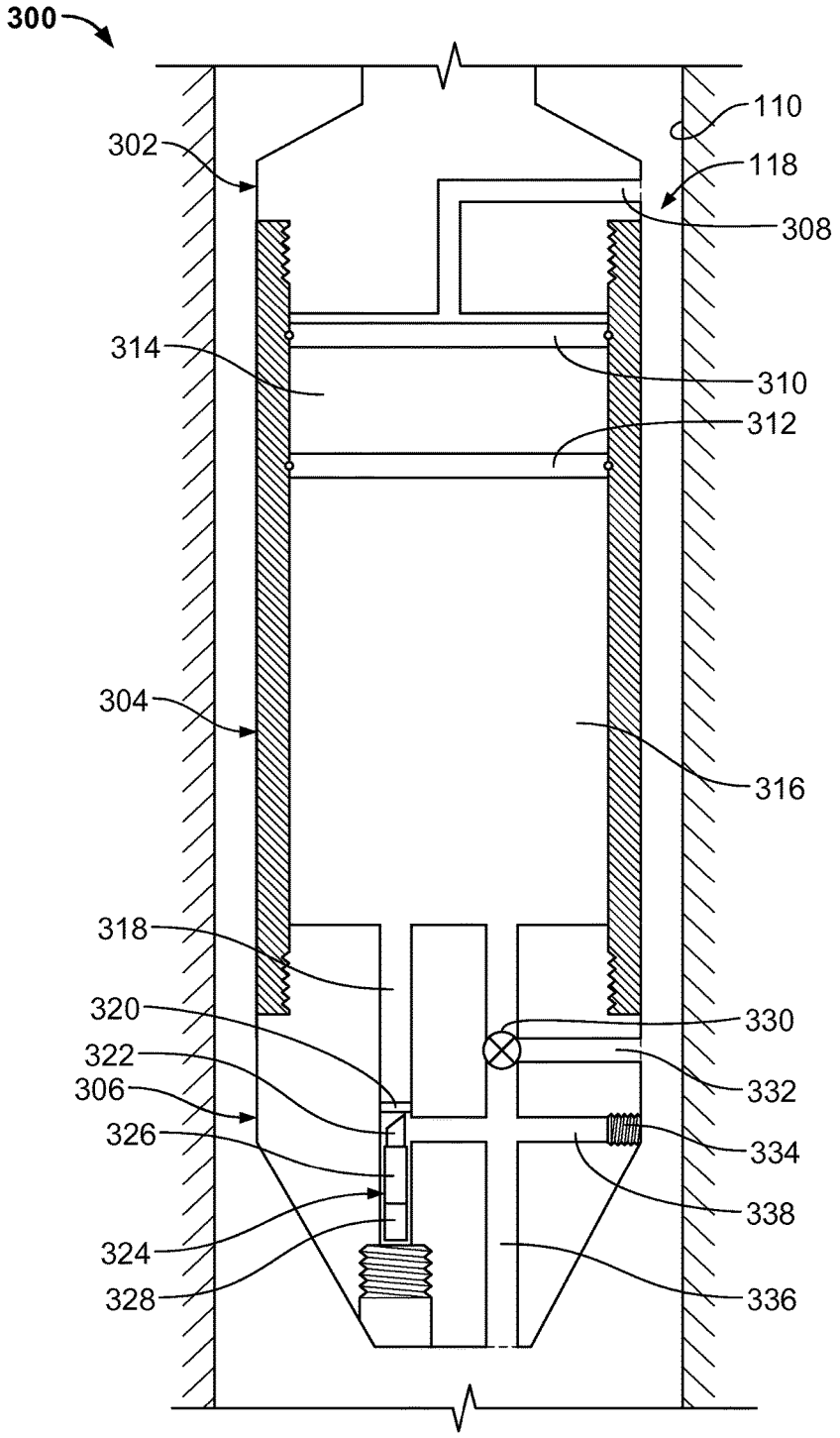
FIG. 3 illustrates a cross-sectional view of another example implementation of a wellbore bailer tool.

FIG. 3 illustrates an alternative example of a wellbore bailer tool 300. The wellbore bailer tool 300 can be used as wellbore bailer tool 124. The wellbore bailer tool 300 includes a bailer top end 302, a tubular 304 and a bailer nose 306. The bailer top end 302 includes a connection for a conveyance 136 from the terranean surface. The tubular 304 is coupled to the bailer top end 302. The tubular 304 is adapted to at least partially enclose a wellbore fluid. The components of the tubular 304 define a top piston 310 arranged in the tubular uphole of the wellbore fluid, a bottom piston 312, an open port 308, a pressure chamber 314 and a fluid chamber 316. The pressure chamber 314 is arranged uphole of the bottom piston 312.

In some implementations the pressure chamber 314 encloses a pressurized material (e.g., gas or fluid) that, for instance, may be chosen for its temperature-dependent expansion properties. In some implementations, the pressure chamber 314 encloses compressed gases (e.g., air). The bailer nose 306 is coupled to the tubular 304. The components of the bailer nose 306 define a conduit 318, a burst disk 320, an actuator 324, an open port 332, a plug 334, an outlet 336, a valve 330 and a fill port 338. The actuator 324 includes a cylinder 326, a control circuit 328 and a pin 322 (e.g., a puncture member adapted to pierce the burst disk 320 based on adjustment of the actuator 324 from an unactuated position to an actuated position). The outlet 336 is a passage fluidly coupled to the fluid chamber 316. The valve 330 is a pressure barrier arranged across the outlet 336.

In operation, in an initial state, the top piston 310 is at top of the tubular 304, proximal to the bailer top end 302. The bottom piston 312 is set at bottom of the tubular 304, proximal to the bailer nose 306. A quantity of fluid (e.g., cement, acid, or other material) is circulated into the fluid chamber 316 through the fill port 338. While the fluid is circulated into the fluid chamber 316, the pressure inside the fluid chamber 316 increases and pushes the bottom piston 312 in an upward direction (e.g., towards the piston 310). The top piston 310 generally remains in the same position. While filling the fluid chamber 316, the open port 308 is closed and the fluid in the pressure chamber 314 is compressed. When the bottom piston 312 reaches a particular level (e.g., corresponding to a particular volume of desired fluid or to the top end of the tubular 304), the fill port 338 is closed by the plug 334 sealing the fluid within the fluid chamber 316. At filling completion, the valve 330 is closed.

In a filled state, the wellbore bailer tool 300 is transported within the wellbore 118. The temperature in the wellbore 318, typically, increases with depth, which induces an expansion of the gas in the pressure chamber 314. During the transportation of the wellbore bailer tool 300 in the wellbore 118, the volume of gas and fluid in the pressure chamber 314 and the fluid chamber 316, respectively, attempt to balance the hydrostatic pressure. Due to the expansion of the gas in the pressure chamber 314, the top piston 310 remains at the top and the pressure in the pressure chamber 314 and the fluid chamber 316 will be greater than hydrostatic pressure.

At a particular location, the wellbore bailer tool 300 is actuated by the actuator 324 to deposit the fluid transported in the fluid chamber 316 in the wellbore 118 (e.g., onto a plug or other wellbore tool). In some implementations, the actuator 324, confined in the cylinder 326, is activated by a control circuit 328. The control circuit 328 includes a timer and a battery. The control circuit 328 generates a mechanical force to the pin 322 to break the burst disk 320. Several types of actuators 324 can be used (as described with reference to FIG. 2). Breaking the burst disk 320 initiates the actuated state of the wellbore bailer tool 300. Once the burst disk 320 is broken, a fluid pressure of the conduit 318 is adjusted to at or near a hydrostatic pressure in the wellbore 118 via the outlet 336. As the pressure of the fluid in the chamber 314 is greater than the hydrostatic pressure, the lower piston 312 is urged, by the fluid in the chamber 314, downward to expel the fluid in the fluid chamber 316 through the conduit 318 and then the outlet 336 into the wellbore 118.

Figure 4:
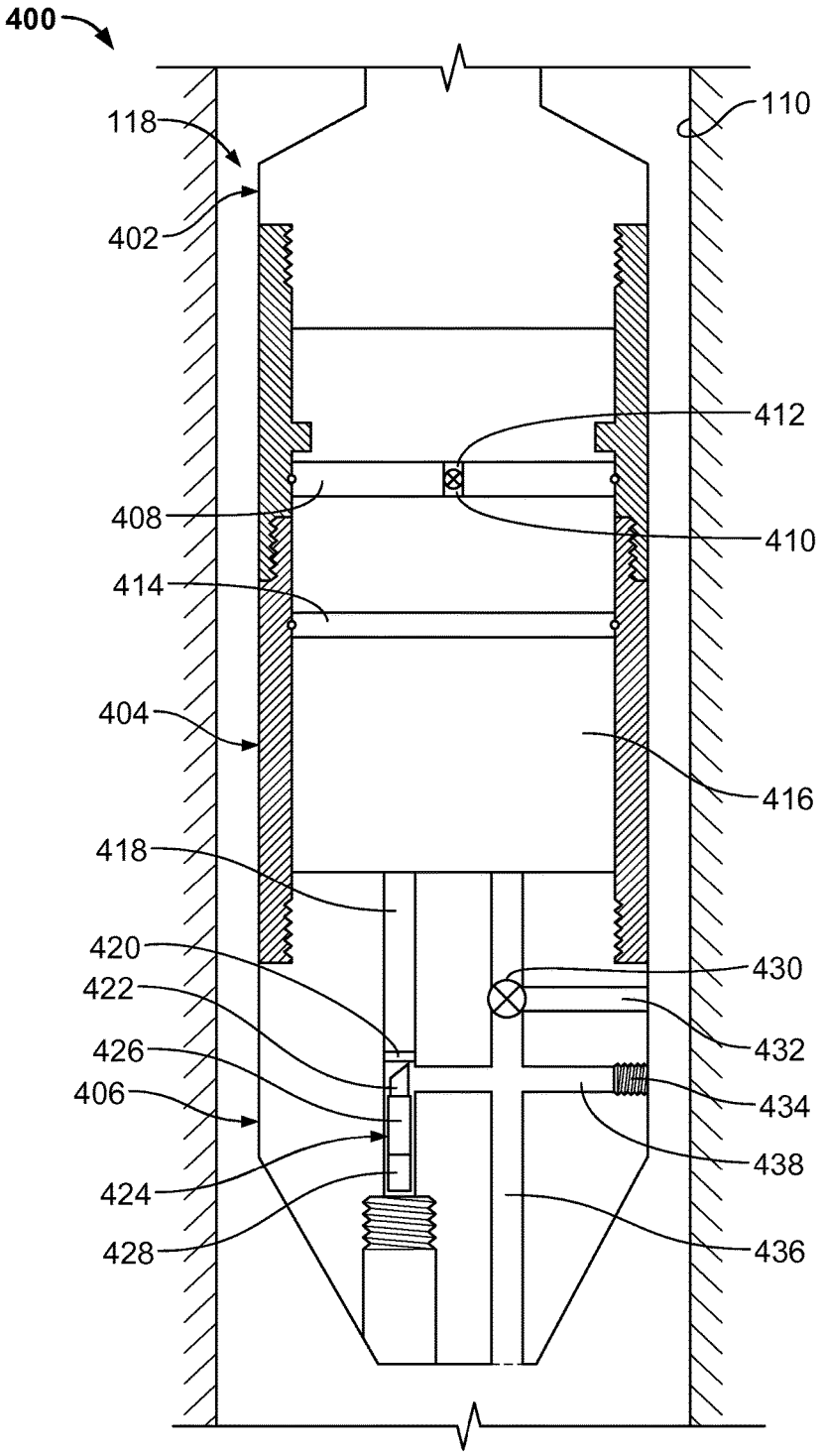
FIG. 4 illustrates a cross-sectional view of another example implementation of a wellbore bailer tool.

FIG. 4 illustrates an alternative example of a wellbore bailer tool 400. The wellbore bailer tool 400 can be used as wellbore bailer tool 124. The wellbore bailer tool 400 includes a bailer top end 402, a tubular 404 and a bailer nose 406. The bailer top end 402 includes a connection for the conveyance 136 from the terranean surface. The tubular 404 is coupled to the bailer top end 402. The tubular 404 is adapted to at least partially enclose a wellbore fluid. The components of the tubular 404 define a top piston 410 arranged in the tubular uphole of the wellbore fluid, a bottom piston 412, a valve 408, a port 409, a pressure chamber 414 and a fluid chamber 416. The top piston 410 includes the valve 408 and the port 409.

The pressure chamber 414 is arranged uphole of the bottom piston 412. In some implementations the pressure chamber 414 encloses a pressurized material (e.g., gas or fluid) that, for instance, may be chosen for its temperature-dependent expansion properties. In some implementations the pressure chamber 414 encloses a fluid (e.g., compressed gas such as air). The bailer nose 406 is coupled to the tubular 404. The components of the bailer nose 406 define a conduit 418, a burst disk 420, a pin 422, an actuator 424, a cylinder 426, a control circuit 428, an open port 432, a plug 434, an outlet 436, a valve 430 and a fill port 438. The actuator 424 includes a puncture member adapted to pierce the burst disk 420 based on adjustment of the actuator 424 from an unactuated position to an actuated position. The outlet 436 is a passage fluidly coupled to the fluid chamber 416. The valve 430 is a pressure barrier arranged across the outlet 436.

In operation, in an initial state, the valves 408 and 430 are open. A pressure source is connected to valve 408 to fill the pressure chamber 414 with gases creating a pre-charge pressure between the top piston 410 and the bottom piston 412. The top piston 410 is at top of the tubular 404, proximal to the bailer top end 402. The bottom piston 412 is set at the bottom of the tubular 404, proximal to the bailer nose 406. The pressure source is disconnected from the wellbore bailer tool 400.

In some implementations, a fluid pump is connected to the fill port 438 to fill the fluid chamber 416 of the wellbore bailer tool 400 with fluid (e.g., cement or other material). While the fluid is pumped into the fluid chamber 416 the pressure inside the fluid chamber 416 increases and pushes the bottom piston 412 up. The top piston 410 remains in the same position. While filling the fluid chamber 416, the valve 408 is closed and the pressure chamber is compressed. When the bottom piston 412 reaches a particular level the fill port 438 is closed by the plug 434 sealing the fluid within the fluid chamber 416 and the wellbore bailer tool 400 is disconnected from the fluid pump. At filling completion the valve 430 is closed. In some implementations, pressure pre-charge is preferred to optimize positive displacement of bottom piston 412. Pressure pre-charge can be accomplished by over pressurizing the fluid in fluid chamber 416 when filling.

In a filled state, the wellbore bailer tool 400 is transported within the wellbore 118. The temperature in the wellbore increases with depth, which induces an increase in pressure of the gas in the pressure chamber 414. During the transportation of the wellbore bailer tool 400 in the wellbore 118, the volume of gas and fluid in the pressure chamber 414 and the fluid chamber 416, respectively, attempt to balance the hydrostatic pressure. Due to the expansion of the gas in the pressure chamber 414, the top piston 410 remains at the top.

At a particular location, the wellbore bailer tool 400 is actuated by the actuator 424 to deposit the fluid transported in the fluid chamber 416 in the wellbore 118. In some implementations, the actuator 424, confined in the cylinder 426, is activated by a control circuit 428. The control circuit 428 provides a mechanical force to the pin 422 to shear the burst disk 420. Several types of actuators 424 can be used (as described with reference to FIG. 2). Breaking the burst disk 420 initiates the actuated state of the wellbore bailer tool 400. Once the burst disk 420 is broken, a fluid pressure of the conduit 418 is adjusted to at or near a hydrostatic pressure in the wellbore 118 via the outlet 436. As the pressure of the fluid in the chamber 414 is greater than the hydrostatic pressure, the lower piston 412 is urged, by the fluid in the chamber 414, downward to expel the fluid in the fluid chamber 416 through the conduit 418 and then the outlet 436 into the wellbore 118.

A number of embodiments have been described. Nevertheless, it will be understood that various modifications may be made. Accordingly, other embodiments are within the scope of the following claims.

What is claimed is:

1. A wellbore bailer, comprising:

a bailer body that comprises a top end, a tubular portion, and a nose, the tubular portion adapted to at least partially enclose a fluid and the nose comprising an outlet;

a piston arranged in the tubular portion uphole of the fluid;

an ambient pressure passage configured to couple a wellbore to at least one of a pressure chamber or the fluid outlet, the pressure chamber arranged uphole of the piston and adapted to at least partially enclose a pressurized fluid;

a pressure barrier arranged across the ambient pressure passage; and an actuator comprising a puncture member adapted to pierce the pressure barrier based on adjustment of the actuator from an unactuated position to an actuated position, the piston urged by the pressurized fluid to forcibly expel the fluid through the outlet based on piercing of the pressure barrier by the puncture member.

2. The wellbore bailer of claim 1, where the ambient pressure passage is configured to couple the wellbore to the pressure chamber.

3. The wellbore bailer of claim 2, where the ambient pressure passage couples the wellbore to the pressure chamber after actuation of the actuator.

4. The wellbore bailer of claim 2, further comprising a flow restriction arranged across the fluid outlet, the flow restriction comprising a one-way check valve or a shear valve.

5. The wellbore bailer of claim 1, where the passage is fluidly coupled to the fluid outlet and the piston comprises a first piston, the bailer further comprising:

a second piston arranged uphole of the pressure chamber, the fluid enclosed between the second piston and the first piston.

6. The wellbore bailer of claim 5, where the passage is fluidly coupled between a downhole surface of the first piston and an exterior of the wellbore after actuation of the actuator.

7. The wellbore bailer of claim 5, further comprising:

an adjustable flow restriction arranged in a passageway of the second piston.

8. The wellbore bailer of claim 1, where the actuator comprises a linear actuator configured to adjust from the unactuated position to the actuated position in response to a pyrotechnic event.

9. The wellbore bailer of claim 8, where the linear actuator further comprises:

a portion of gas ignitable by the pyrotechnic event to exert a force to move the puncture member to pierce the pressure barrier;

a linear actuator circuit that is coupled to a switch, the switch adjustable from an open position to a closed position to generate the pyrotechnic event.

10. The wellbore bailer of claim 9, where the linear actuator circuit comprises:

a capacitor coupled in series with one or more timers;

a battery coupled across the capacitor; and a transistor through which an energy stored in the capacitor flows to ignite a pyrotechnic initiator to generate the pyrotechnic event.

11. The wellbore bailer of claim 9, where the linear actuator circuit is adapted to couple to a wireline and the switch is adjustable from the open position to the closed position based on a powered signal received by the linear actuator circuit on the wireline.

12. The wellbore bailer of claim 1, where the fluid comprises a cement slurry.

13. The wellbore bailer of claim 1, further comprising a fill port fluidly coupled to the tubular portion.

14. A method, comprising:

receiving a powered signal at a wellbore bailer that comprises a tubular adapted to at least partially enclose a fluid;

actuating an actuator of the wellbore bailer with the powered signal;

based on the actuation, urging a pin of the actuator to pierce a burst disk arranged across an ambient pressure passageway that fluidly couples a wellbore to at least one of a pressure chamber of the wellbore bailer or a fluid outlet of the wellbore bailer; and based on piercing of the burst disk by the pin, urging a piston of the wellbore bailer that is arranged in the tubular uphole of the fluid to forcibly expel the fluid through the fluid outlet with a pressurized fluid at least partially enclosed within the pressure chamber.

15. The method of claim 14, where the ambient pressure passageway fluidly couples the wellbore to the pressure chamber, the method further comprising:

based on piercing of the burst disk by the pin, fluidly coupling the pressure chamber to the wellbore through the ambient pressure passageway such that a pressure of the fluid in the pressure chamber is at or about a hydrostatic pressure in the wellbore.

16. The method of claim 15, where the hydrostatic pressure of the wellbore is greater than a pressure of the fluid enclosed in the tubular prior to piercing the burst disk.

17. The method of claim 14, where the passageway is fluidly coupled to the fluid outlet and the piston comprises a first piston, the method further comprising:

enclosing the fluid in the tubular between the first piston and a second piston that is arranged uphole of the pressure chamber; and receiving the wellbore fluid into the tubular through a fill port to urge the first piston from near a nose of the wellbore bailer coupled to the tubular toward the top of the wellbore bailer to pressurize the pressurized fluid at least partially enclosed within the pressure chamber.

18. The method of claim 17, further comprising:

further pressurizing the pressurized fluid in the pressure chamber as the wellbore bailer is moved through the wellbore from the terranean surface.

19. The method of claim 18, where the further pressurized fluid is at a pressure equal to or greater than a hydrostatic pressure of the wellbore prior to actuation of the actuator.

20. The method of-claim 14, where actuating an actuator of the wellbore bailer with a powered signal comprises initiating an explosive charge in response to the powered signal to actuate the actuator.

21. The method of claim 20, where initiating an explosive charge comprises:

closing a switch in response to the powered signal; and igniting a portion of gas proppant by the explosive charge to exert a force to move the pin to pierce the burst disk.

22. The method of claim 21, further comprising:

receiving, at the switch, the powered signal from one of a conveyance coupled to the wellbore bailer or a linear actuator circuit of the actuator.

23. The method of claim 14, where the fluid comprises a cement slurry.

24. A positive displacement wellbore bailer, comprising:

a tubular adapted to enclose a portion of a first fluid for a wellbore completion operation;

a pressure chamber adapted to enclose a volume of a second fluid at a determined pressure;

a floating piston arranged in the tubular between the first fluid and the second fluid;

an ambient pressure passage configured to couple a wellbore to at least one of the pressure chamber or the tubular; and a linear actuator arranged within the wellbore bailer, the linear actuator adapted to penetrate a burst disk arranged across the ambient pressure passage, and upon actuation cause the floating piston to forcibly expel the first fluid from an outlet of the wellbore bailer.

25. The positive displacement wellbore bailer of claim 24, where the ambient pressure passage fluidly couples the wellbore to the pressure chamber after actuation of the linear actuator.

26. The positive displacement wellbore bailer of claim 24, where the flow path is fluidly coupled to the tubular, and the flow path is fluidly coupled between a downhole surface of the floating piston and an exterior of the wellbore after actuation of the linear actuator.

* * * * *